US008485754B2

(12) United States Patent
Bathelt

(10) Patent No.: US 8,485,754 B2
(45) Date of Patent: Jul. 16, 2013

(54) NO-GAP WINCHING ENDS FOR A RIG MAT

(75) Inventor: Jared Michael Bathelt, Leduc (CA)

(73) Assignee: Strad Energy Services Ltd., Calgary (CA)

( * ) Notice: Subject to any disclaimer, the term of this patent is extended or adjusted under 35 U.S.C. 154(b) by 0 days.

(21) Appl. No.: 13/268,178

(22) Filed: Oct. 7, 2011

(65) Prior Publication Data

US 2012/0087725 A1 Apr. 12, 2012

Related U.S. Application Data

(60) Provisional application No. 61/391,131, filed on Oct. 8, 2010.

(51) Int. Cl.
*E01C 9/08* (2006.01)

(52) U.S. Cl.
USPC ..... 404/35

(58) Field of Classification Search
USPC ..... 404/35, 36; 52/664, 669; 108/51.11, 108/56.1, 56.3, 57.17–57.25, 57.32
See application file for complete search history.

(56) References Cited

U.S. PATENT DOCUMENTS

| | | | | |
|---|---|---|---|---|
| 3,595,140 | A * | 7/1971 | Lundin | 404/35 |
| 5,603,134 | A * | 2/1997 | Whipkey et al. | 14/2.4 |
| 6,089,784 | A * | 7/2000 | Ardern | 404/41 |
| 6,981,818 | B1 * | 1/2006 | Lange | 404/73 |
| 7,934,885 | B2 * | 5/2011 | Fournier | 404/35 |
| 2008/0053343 | A1 * | 3/2008 | Relland | 108/151 |
| 2009/0087261 | A1 * | 4/2009 | Fournier | 404/35 |
| 2009/0297266 | A1 * | 12/2009 | Stasiewich et al. | 404/36 |
| 2010/0209187 | A1 * | 8/2010 | Relland et al. | 404/35 |
| 2011/0233363 | A1 * | 9/2011 | Wold | 248/346.01 |
| 2012/0063844 | A1 * | 3/2012 | Wold | 404/35 |

* cited by examiner

*Primary Examiner* — Thomas B Will
*Assistant Examiner* — Abigail A Risic
(74) *Attorney, Agent, or Firm* — Sean W Goodwin

(57) ABSTRACT

A rig mat implements opposing winching ends having a surface extension that is co-planar with the working surface of the rig mat. Such a co-planar surface can be a rectangular hollow tubing, the top surface of which forms the co-planar surface and a sidewall which forms a depending abutting member. The co-planar surface and the depending member enable the winching ends to form a substantially continuous planar interface between abutting winching ends of adjacent rig mats to minimize discontinuity therebetween. Fabrication is simplified and savings in weight are realized.

12 Claims, 7 Drawing Sheets

NO-GAP WINCHING ENDS FOR A RIG MAT

CROSS REFERENCE TO RELATED APPLICATIONS

This application claims the benefits under 35 U.S.C 119(e) of U.S. Provisional Application Ser. No. 61/391,131, filed Oct. 8, 2010, which is incorporated fully herein by reference.

FIELD OF THE INVENTION

Embodiments described herein relate generally to forms of winching ends for rig mats, to a rig mat employing the winching ends, to the interface between adjacent and like winching ends, and to methods of manufacture and economies of material and labour.

BACKGROUND OF THE INVENTION

Rig mats have been used for many years to provide a level working surface over unstable and environmentally sensitive terrain for supporting the operation and movement of heavy equipment or vehicles thereon. A multiplicity of individual rig mats are typically arranged in an array, assembled on site, for forming a large working surface. The individual mats can be readily transported, used and reused for building temporary work surfaces of various desired dimensions.

As shown in FIG. 1A, a conventional rig mat consists of a generally rectangular planar steel frame having parallel sides and parallel mat ends. Rig mats are provided in a variety of sizes, however a common size includes a mat having a width of about 8 feet and sides having a length of about 40 feet. The frame encloses a grid of spaced apart, cross members, openings between which can be filled with panels of wood or composite materials. The panels sit in the openings, flush with a top working surface of the planar frame.

As shown in FIGS. 1B and 1C, each of the mat ends are typically configured with winching end structure to enable the connection of slings and the like for on-site manipulation, loading and unloading of the rig mats from transport trailers. The known winching structure comprises a pipe secured along the length of each mat end. Affixing the pipe is associated with significant material and labor cost to secure it to the rig mat. Mat ends are square and the pipe is round providing a difficult fabrication. As shown in FIG. 1B, the pipe extends along the mat end and a top flat bar or plate also extends along the mat end for welded connection to the mat end along one side and to the pipe along the parallel and opposing side. To secure the bottom of the pipe to the mat end, a plurality of gussets are welded periodically along the mat end and transverse of an axis of the pipe, extending between a lower quadrant of the pipe and the mat end. To further strengthen the connection between the pipe and the rig mat, a lower flat bar or plate is added as a lower brace, welded again at the pipe and at the mat end. The top plate, gussets and lower brace add to the cost of the rig mat module in material and labor. The lower brace, gussets and the top plate also increase the weight of the rig mat module. Further, the diameter of the pipe and the gussets also decrease the clearance beneath the pipe and a surface such as a trailer deck or ground, on which the rig mat module is supported. The reduced clearance makes it difficult for an operator to pass a winch cable around the winching ends for lifting and winching the rig mat modules. Accordingly when stacked on top of each other, conventional rig mats are separated by spacers to increase the clearance therebetween. Further, a spacer is sometimes also used between the mat and the ground to space the mat thereabove to increase the clearance therebetween. The process of adding spacers is labour intensive.

One known arrangement includes arranging rig mats end-to-end; arranging a winching end of one rig mat against a winching end of another rig mat. In the prior art, the two pipes of adjacent rig mats are abutted together, forming a nip, gap or a discontinuity formed therebetween. The discontinuity in the otherwise planar working surface can result in a safety hazard, increasing the likelihood for personnel to twist their ankles or trip.

There is a need for a rig mat which in addition to providing a rigid surface, ensures safety of personnel working on the rig mat, is economical, relatively lightweight and easy to assemble.

SUMMARY OF THE INVENTION

Embodiments described herein are directed to winching ends of rig mats. These improvements enable the winching ends to form a substantially continuous working surface between abutting winching ends of adjacent rig mats.

Accordingly in one broad aspect a winching end for a rig mat is provided. The rig mat has a rectangular frame having a planar working surface, a bottom surface, a mat width between parallel sides and parallel mat ends. The bottom surface is supportable upon a resting surface. The sides are inset from the sides adjacent each mat end to form a recess and a mat end having a width less than that between the sides. The winching end abuts to the winching end of at least one additional rig mats. The winching end comprises a co-planar surface secured along the mat end and having a length between tips being substantially that of the mat width. The coplanar surface also extends outwardly from the working surface of the mat end and has a distal end spaced therefrom. A depending member extends downwardly from the distal end of the co-planar surface. The depending member abuts a corresponding depending member of the at least one additional rig mat and the co-planar surface forms a substantially continuous planar surface with the co-planar surface of the at least one additional rig mat.

Accordingly in another broad aspect a rig mat is provided. The rig mat comprises opposing winching ends which are as described above.

Accordingly in another broad aspect a rig mat system is provided. The rig mat system comprises a plurality of rig mats arranged in an array. Each rig mat comprises opposing winching ends which are as described above.

BRIEF DESCRIPTION OF THE INVENTION

Herein, embodiments are directed to improvements to a rig mat, such improvements to rig mat winching ends enabling a substantially continuous planar interface between abutting winching ends of adjacent rig mats to minimize discontinuity therebetween and providing the environment for ease of rigging for lifting winching ends of such rig mat.

Figure 1A:
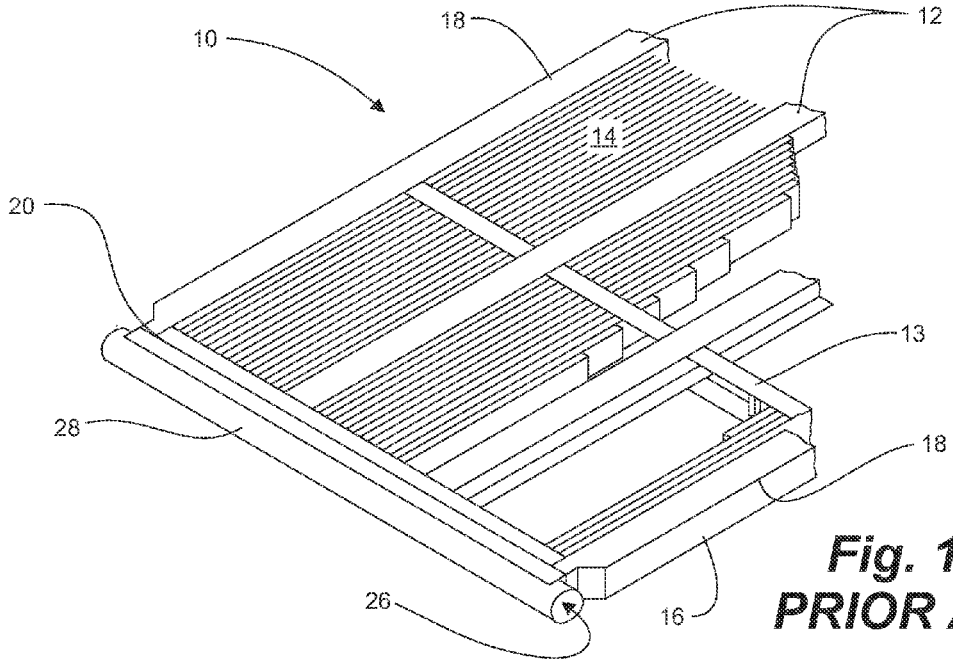
Fig. 1A PRIOR ART
FIG. 1A is a partial perspective view of one end of a prior art rig mat illustrating rounded pipes at one of the two opposing winching ends of the rig mat.
Figure 1B:
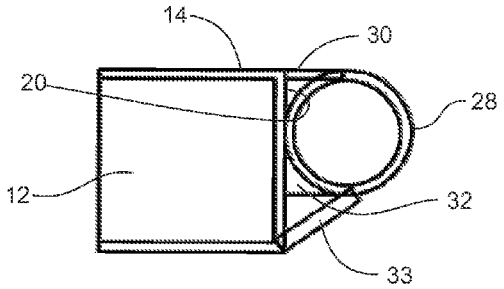
Fig. 1B PRIOR ART
FIG. 1B is a side view of the prior art winching end of FIG. 1A, demonstrating a typical fabrication technique for strengthening the connection between the rounded pipe and mat ends.
Figure 1C:
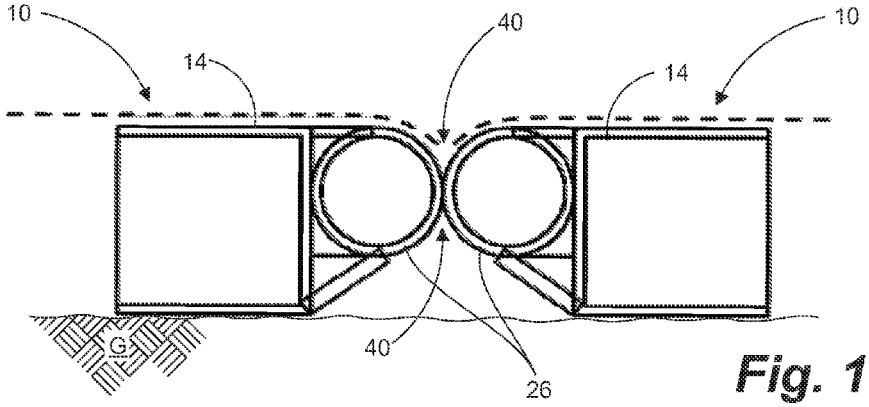
Fig. 1C PRIOR ART
FIG. 1C is a side view of abutting winching ends of two prior art rig mats according to FIG. 1A, abutted end-to-end and illustrating the discontinuity formed therebetween.

With reference to FIG. 1A a prior art rig mat 10 has a generally rectangular planar steel frame 12 having a working surface 14, a bottom surface 16, like parallel sides 18 and like mat ends 20. The frame 12 further comprises a grid formed by spaced apart, cross members 13 for receiving wood beams, decking or composite panels 22 fit flush with working surface 14. The mat ends 20 are fit with winching ends 26 comprising rounded pipes 28, having a circular cross-section, secured along the length of mat ends 20. As shown in FIG. 1B, the rounded pipes 28 are typically secured to the mat ends 20 by welding a variety of strengthening plates between the pipe 28 and the mat end 20 including a top plate 30, gussets 32 spaced periodically along the mat end, and a lower plate or brace 33 between a lower quadrant of the pipe 28 and the mat end 20. With reference to FIG. 1C, two rig mats 10,10 of the prior art are shown adjacent and abutting at an interface 40 between their winching ends 26,26. The rig mats are supported on their bottom surface 16 upon a surface such as the ground G. The interface 40 of the rounded pipes 28 creates a nip, gap or discontinuity between the working ends 26,26 and along the otherwise planar working surfaces 14,14. It is this gap or discontinuity at the interface 40, in an otherwise planar working surface 14, which creates the safety hazard.

Figure 2A:
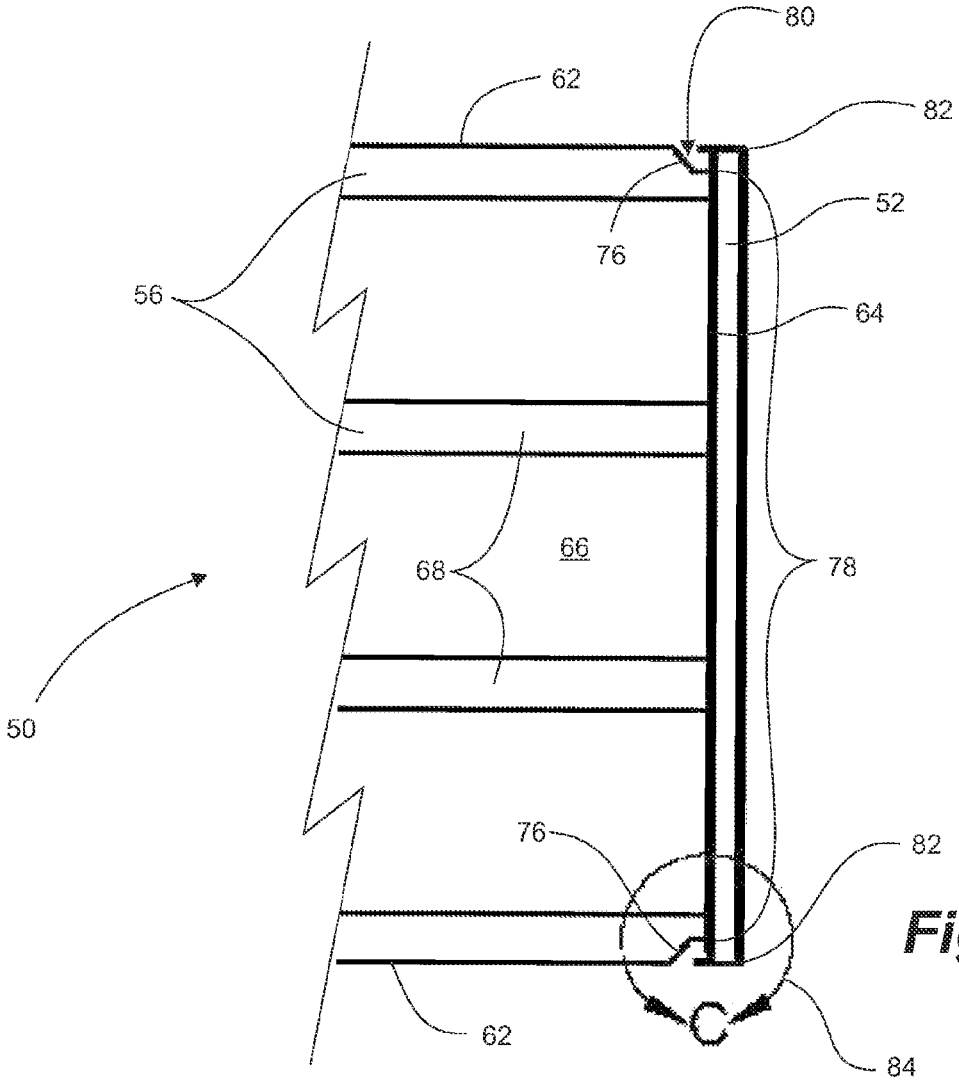
FIG. 2A is a partial plan view of one end of a rig mat according to one embodiment.
Figure 2B:
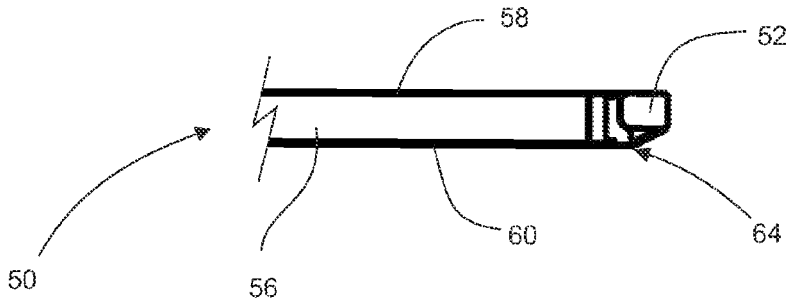
FIG. 2B is a side view of the partial rig mat of FIG. 2A.

Turning to a first embodiment, and having reference to FIGS. 2A and 2B, rig mats 50 are provided with improved winching ends 52, having superior fabrication economics and resulting in a no-gap interface between end-to-end abutting rig mats 50,50 (see FIGS. 6A and 6B), which results in a substantially continuous working surface 54 and providing a safer working surface for personnel traversing an array of assembled rig mats 50,50 . . . .

With reference to FIGS. 2A and 2B, a rig mat 50 comprises the rectangular planar steel frame 56, the top surface or working surface 58, the bottom surface 60, parallel sides 62 and the mat ends 64. Openings 66 in the frame 56 are typically with panels for forming part of the planar working surface 58. Each mat end 64 of the rig mat 50 is provided with a winching end 52 secured along a length of the mat end 64.

The winching end 52 has opposing ends exposed for enabling access for winching. Accordingly, each of the sides 62 of the rig mat 50 are laterally inset adjacent each mat end 64 to form shoulders 76 and a neck 78 at each mat end 64. As a result the necked-in mat end 64 has neck width less than that of the width of the rig mat 50 itself. The winching end 52 extends along the neck 78 of the mat end 64 and has a length between tips 82 of about that of the width of the rig mat 50. Accordingly, the winching end has an extent between tips 82,82 which extends beyond the extent of the neck 78.

Figure 3:
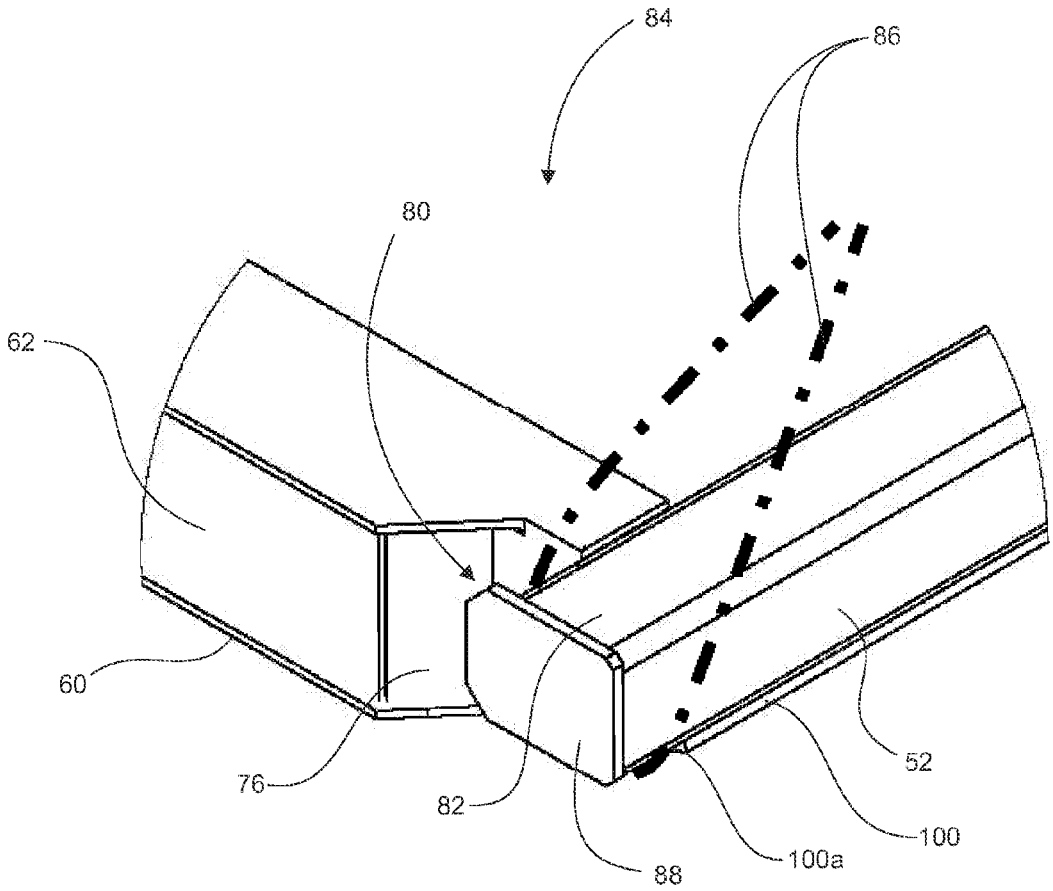
FIG. 3 is a partial perspective view of a lifting corner of circled area "C" of FIG. 2A illustrating engagement of a chain or winch cable around the tip of the winching end at a lifting corner.
Figure 4:
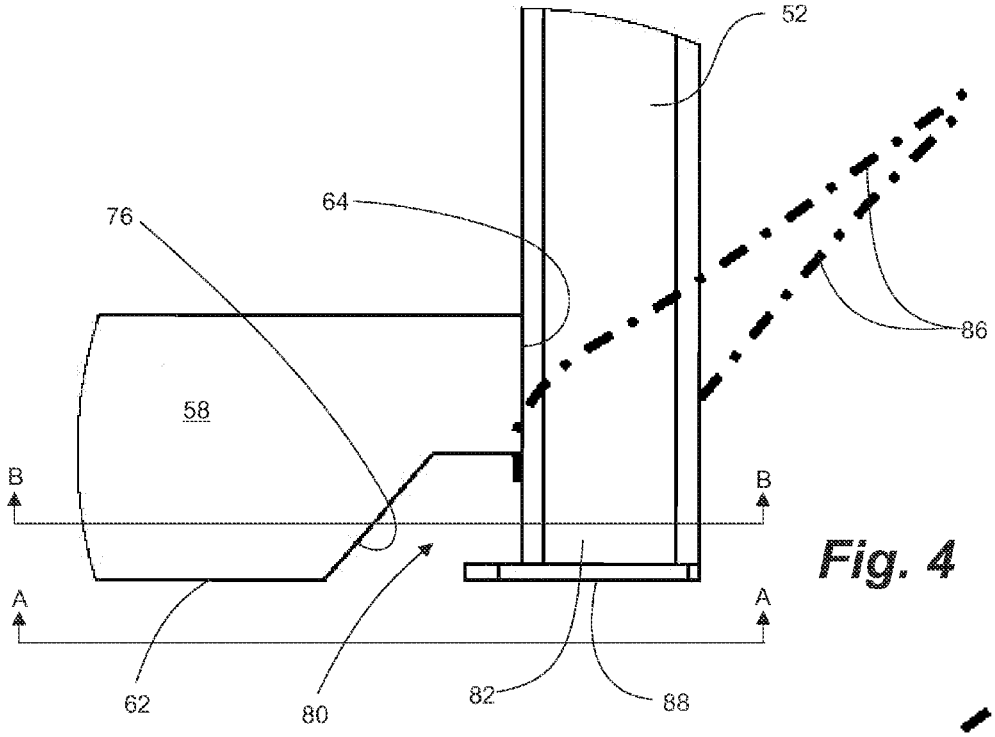
FIG. 4 is a plan view of a lifting corner of the rig mat at circle "C" of FIG. 2A.

With reference also to FIGS. 3 and 4, the tips 82 extend laterally beyond the extents of the neck 78 and form a recess 80 between each tip 82 and the shoulder 76 forming a lifting corner 84. The lifting corners 84 facilitate use of a lifting member 86 such as a sling, chain or winch cable for lifting that end of the rig mat 50. Dog-ears 88 can be provided at the lifting corners 84 for preventing the cable 86 from sliding off the tips 82 of the lifting corners 84.

Figure 5A:
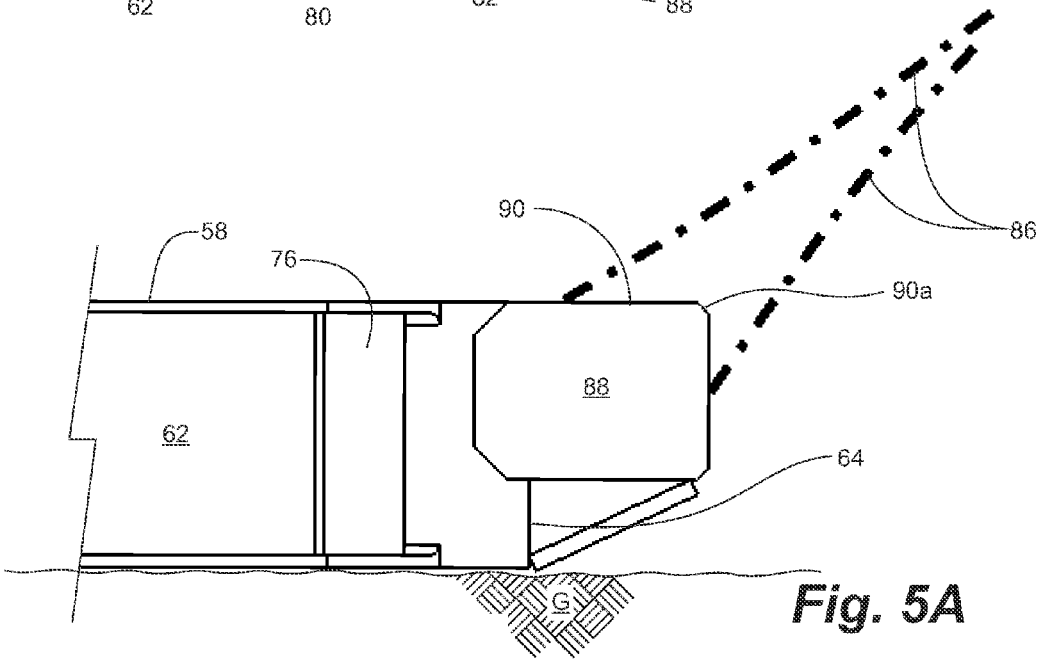
FIG. 5A is a side view of the lifting corner along line A-A of FIG. 4, illustrating a dog-ear at the tip of the winching ends and a strengthening brace.
Figure 5B:
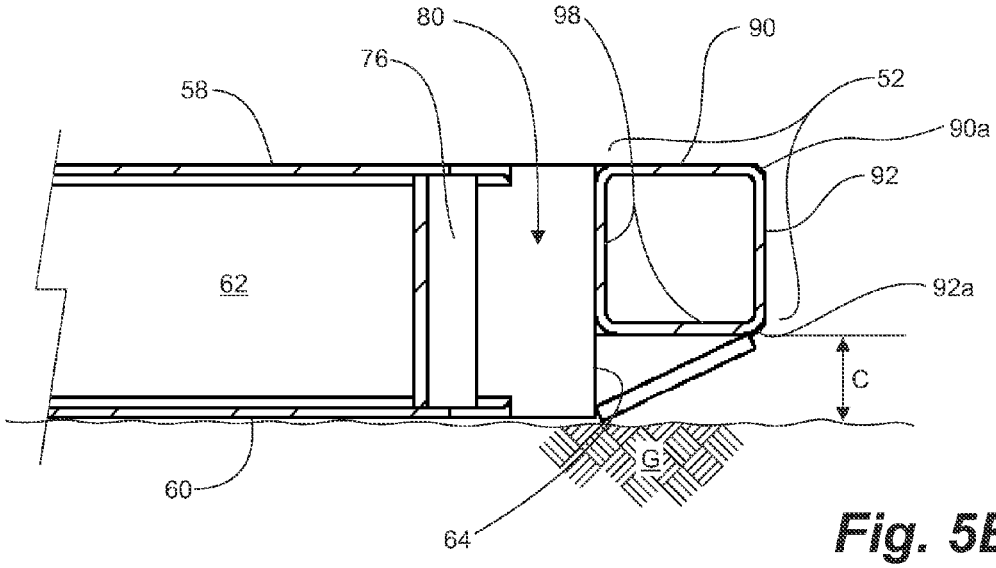
FIG. 5B is a side of a lifting corner along line B-B of FIG. 4 illustrating a hollow tubing winching end.
Figure 5C:
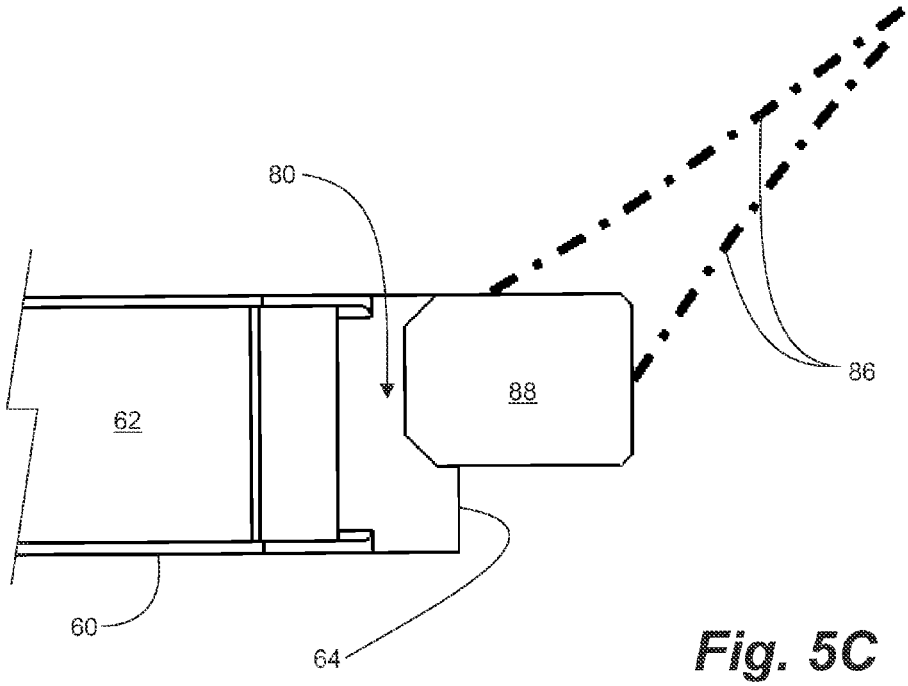
FIG. 5C is another embodiment according to FIG. 5A, absent the strengthening brace.

With reference to FIGS. 5A and 5B, the winching end 52 comprises the addition of structure for extending the planar working surface 58 and being co-planar therewith. As shown in FIG. 5B, in one embodiment, the winching end 54 comprises a co-planar surface 90 extending outwardly from the mat end 64 to a distal end 90*a*, spaced from the mat end 64. As shown in 6B, the distal end 90*a* of one rig mat 50 abuts the distal end 90*a* of the co-planar surface 90 of an adjacent rig mat 50 arranged end-to-end.

A depending member 92 extends downwardly from the distal end 90*a* towards the ground G. The depending member 92 can provide additional abutment and structural aspects to the winching end 52. As shown in FIG. 5B, a bottom end 92*a* of the depending member 92 is spaced from the bottom surface 60 of the rig mat 50 to form a clearance C between the depending member 92 and the rig mat's bottom surface 60. The bottom surface 60 rests on the ground G. The use of the term ground G includes other resting surfaces upon which the rig mats rest, such as the bed of transport trailers and stacks of other rig mats. The clearance C to the bottom surface 60 is generally equivalent to the clearance between the winching end 52 and the ground G. In one embodiment, the co-planar surface 90 and the depending member 92 are formed by two adjacent top and side surfaces of rectangular hollow tubing 98. According, and with reference to FIG. 5B as well as FIG. 6B, the depending member 92 is a substantially perpendicular to the co-planer surface 90. The hollow tubing 98, forming the winching end 52, extends along the mat end 64. The hollow tubing 98 is secured such as by welding W to the mat end 64 at the interface of the co-planar surface 90 and mat end 64. A second securement, or weld W, can be made to the mat end 64 at a bottom interface 99 of the bottom of the hollow tubing 98. Accordingly, only two welds W,W would be made along width of the mat end 64. The hollow tubing 98 can be rectangular or square tubing suitable to provide a co-planar surface 90. The hollow tubing is in itself a structural member and may not need further reinforcement.

Figure 7A:
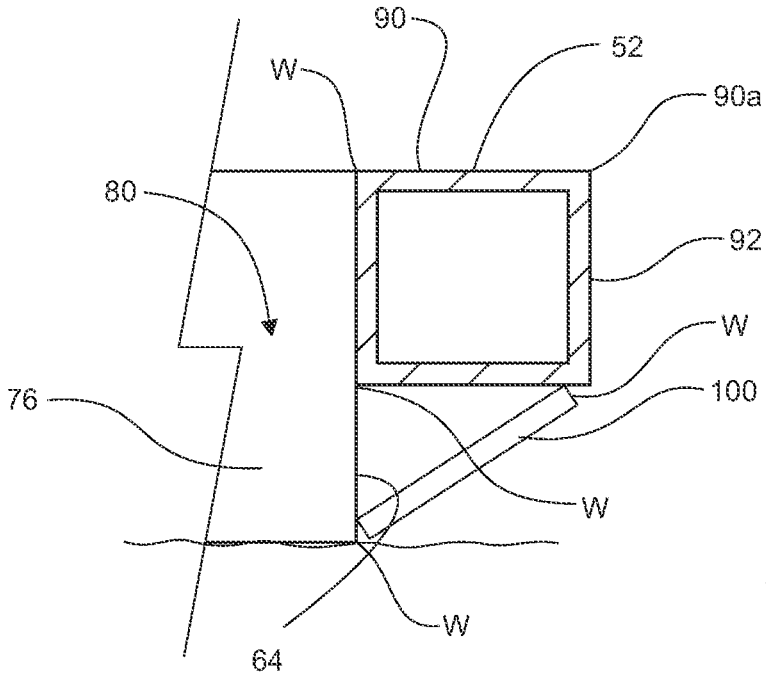
FIG. 7A is a side view of a winching end having a brace secured thereto.
Figure 7B:
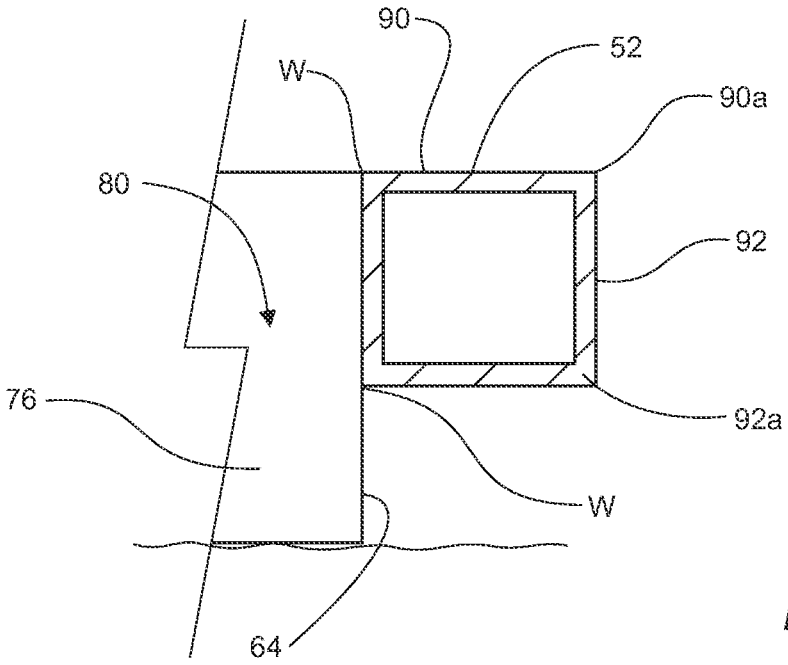
FIG. 7B is a side view of a rectangular hollow tubing without gussets or other strengthening plates.

The prior art pipe 28 of FIG. 1A requires at least four welds along the width of the mat end 20, with additional weldment for each gusset 32. In the described embodiment of FIG. 7B, the rectangular hollow tubing 98 does not require gussets or an additional top plate for strengthening its connection to the mat end 64. This reduces the overall weight of the rig mat 50 and reduces fabrication. On an average, there are about 12 feet less welds per rig mat (two mat ends) because of the absence of the gussets and the prior art top plate. This is a significant improvement relative to the existing rig mat 10 having rounded pipes 28 at the winching ends 26.

In one embodiment of FIGS. 5A, 5B, 5C and 7A, the connection of the hollow tubing 98 and mat end 64 can be further modified by the addition of a strengthening member which extends between the distal or bottom end 92*a* of the depending member 92 and the mat end 64. The strengthening member can be a generally rectangular lower plate or brace 100 extending along the mat end 64 between the depending member 92 and the mat end 64. The brace 100 can provide handling advantages as a ramp to align slightly overlapping ends, allowing a upper winching end over a lower winching end to slide down to the ground G and into a planar orientation. Further, as desired, the brace 100 can provide additional strengthening. The brace 100 is secured such as by welding W to the depending member's distal end 92*a* and welding to the mat end 64.

With reference also back to FIG. 3, to avoid interference with the lifting cable access provided by recess 80, terminations 100*a* of the lower plate 100 are set back from the tips 88, such as by terminating at the ends of the neck 78 for maintaining the clearance beneath the hollow tubing 98 and facilitating engagement or rigging of a winch cable 86 around the lifting corners 84.

Figure 6A:
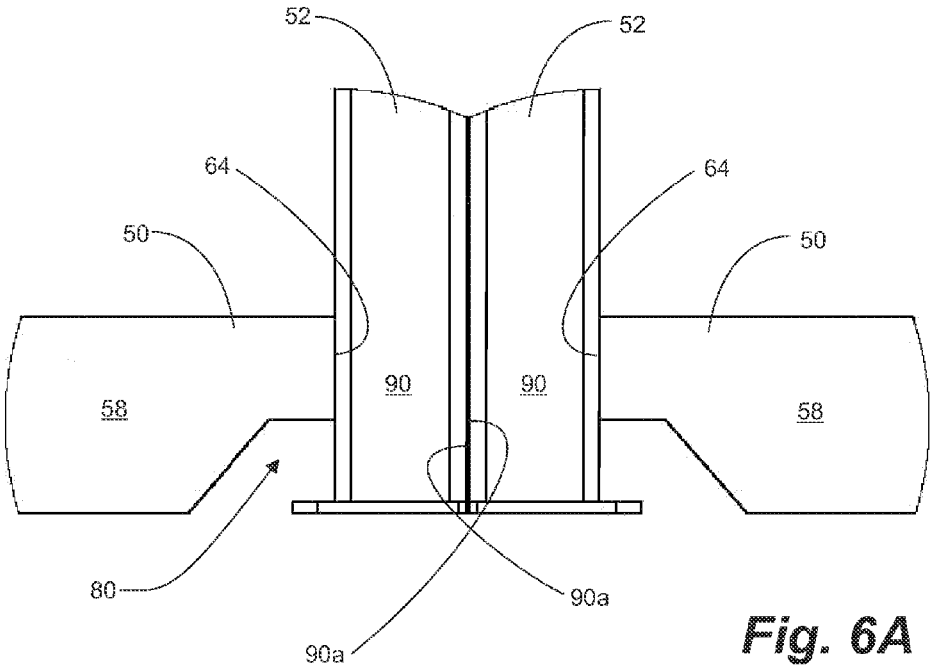
FIG. 6A is a partial plan view of one tip of the winching ends of two abutting rig mats of FIG. 2A placed winching end-to-winching end illustrating a continuity of the planar working surface therebetween.
Figure 6B:
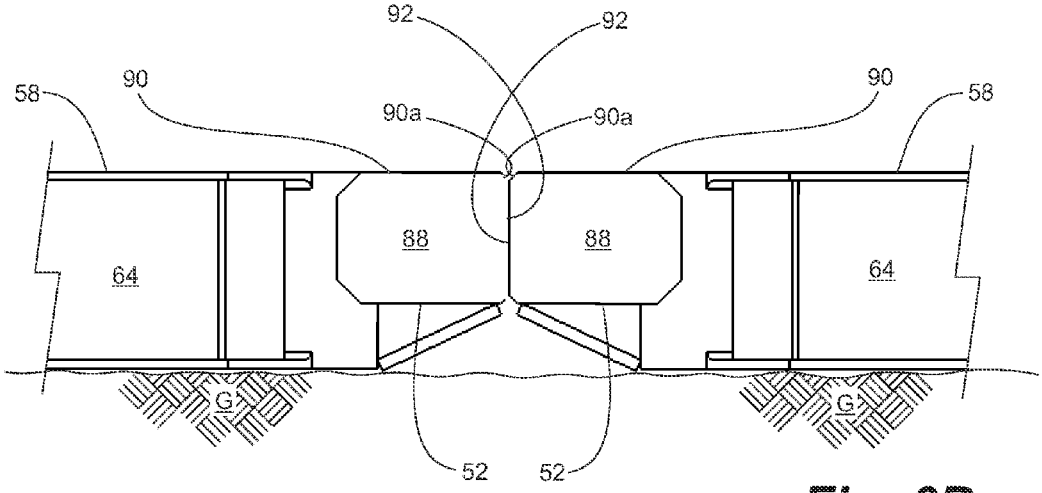
FIG. 6B is a side end view of the abutting winching ends of the abutting rig mats of FIG. 2B placed end-to-end illustrating a continuity of the planar working surface therebetween.

With reference to FIGS. 6A and 6B, in use, a first rig mat 50 is arranged adjacent at least one additional and adjacent rig mat 50 in an end-to-end arrangement, the winching ends 52 abutting along their respective depending members 92. The depending member 92 has a length which enables the depending member 92 to abut the corresponding depending member 92 despite some potential for differential elevation tolerance. The distal end 90*a* of one co-planer surface 90 is adjacent the distal end 90*a* of the other abutting rig mat forming a substantially continuous planar surface 58 between the two rig mats 50,50 and eliminates the discontinuity of the prior art. The planar surface 58 provides a no-gap, planar and safe working surface between the winching ends 52.

In the prior art, conventional rounded pipe 28 winching ends are formed of 4.5 inch diameter pipe whereas in one embodiment herein, hollow square tubing 98 can have 4 inch outside edge cross-section. The decreased height of the hollow tubing 98 provides 0.5 inch extra clearance between the lifting corners 84 and the ground G. Elimination of prior art gussets and a brace further increases the clearance between the lifting corners 84 and the ground G. The increased clearance enables engagement of winch cable 86 around the lifting corners 84 without the need for supplemental spacers. The elimination of spacers decreases the components and labour involved in assembling the rig mats 50.

With the prior art rig mats, in order to get a 40' usable length, the mat must be 40' 3" including the rounded pipe 28. Whereas the rig mat 50 described herein can be 40' long with 40' of usable working surface area including the winching ends 52.

Rig mats 50 fabricated as described herein are lighter and safer once assembled compared to conventional rig mats 10 and meet the safety requirements imposed by the industry. The rig mat 50 described herein uses less material and requires less labour to fabricate.

The improved rig mat 50 provides the following technical advances not currently known in the prior art including: the ability to rig up to a winching end without extra tools (blocks and spacers), to retain same strength with less steel than industry standard designs, to increase the usable surface area of rig mat with less material used, require less labour than an industry standard designs, and increased safety than existing industry standard designs.

The embodiments of the invention for which an exclusive property or privilege is claimed are defined as follows:

1. A winching end for a rig mat, the rig mat having a rectangular frame having a planer working surface, a bottom surface, a mat width between parallel sides and parallel mat ends, the bottom surface supportable upon a resting surface, the sides being inset from the sides adjacent each mat end to form a recess and a mat end having a width less than that between the sides, the winching end abutting to the winching end of at least one additional rig mats, the winching end comprising:

rectangular hollow tubing having a length between tips being substantially that of the mat width, adjacent top and side surfaces forming a co-planar surface and a depending member respectively;

the co-planar surface secured along the width of the mat end, the coplanar surface also extending outwardly from the working surface and coplanar therewith and having a distal end spaced from the mat end;

the depending member extending downwardly and perpendicularly from the distal end of the co-planar surface, a bottom end of the depending member being spaced from the bottom surface of the mat for forming a clearance;

a strengthening member extending between the bottom end of the depending member and the bottom surface at the mat end and extending along the mat end, wherein the depending member abuts a corresponding depending member of the at least one additional rig mat and the co-planar surface of the rig mat forms a substantially continuous planar surface with the co-planar surface of the at least one additional rig mat.

2. The winching end of claim 1 wherein the hollow tubing is welded to the mat end between the first surface and the mat end and between a bottom interface of a bottom of the hollow tubing and the mat end.

3. The winching end of claim 2 wherein the hollow tubing is square hollow tubing.

4. The winching end of claim 1 wherein strengthening member is a rectangular plate extending along the depending member and the mat end, terminations of the plate being inset from the tips.

5. The winching end of claim 4 wherein the clearance and the insets enable rigging of a lifting member around the tips.

6. The winching end of claim 5 wherein the lifting member is selected from the group consisting of a sling, chain and a cable.

7. A rig mat comprising opposing winching ends according to claim 1.

8. A rig mat system comprising a plurality of rig mats arranged in an array, each rig mat comprising opposing winching ends according to claim 1.

9. The rig mat system of claim 8 wherein the length of each rig mat between the opposing winching ends is about 40 feet.

10. The winching end of claim 3 wherein strengthening member is a rectangular plate extending along the depending member and the mat end, terminations of the plate being inset from the tips.

11. The winching end of claim 10 wherein the clearance and the insets enable rigging of a lifting member around the tips.

12. The winching end of claim 11 wherein the lifting member is selected from the group consisting of a sling, chain and a cable.

* * * * *